US006280354B1

(12) United States Patent
Bertolotti

(10) Patent No.: US 6,280,354 B1
(45) Date of Patent: Aug. 28, 2001

(54) MONOLITHIC STRING NETWORK FOR SPORT RACKETS

(76) Inventor: Fabio P Bertolotti, c/o United Technologies Research Center 411 Silver La., E. Hartford, CT (US) 06108

( * ) Notice: Subject to any disclaimer, the term of this patent is extended or adjusted under 35 U.S.C. 154(b) by 0 days.

(21) Appl. No.: 09/537,463

(22) Filed: Mar. 27, 2000

(51) Int. Cl.[7] ..... A63B 51/02
(52) U.S. Cl. ..... 473/543; 473/540
(58) Field of Search ..... 473/540, 541, 473/542, 543, 532, 516, 524, 527, 528

(56) References Cited

U.S. PATENT DOCUMENTS

| | | | | |
|---|---|---|---|---|
| 3,834,699 | | 9/1974 | Pass . | |
| 3,921,979 | | 11/1975 | Dischinger . | |
| 3,934,876 | | 1/1976 | Haddad . | |
| 4,095,790 | | 6/1978 | Swiecicki . | |
| 4,118,029 | | 10/1978 | Septier . | |
| 4,149,722 | | 4/1979 | Yager . | |
| 4,163,553 | | 8/1979 | Renfro . | |
| 4,184,679 | | 1/1980 | Mishel . | |
| 4,190,249 | | 2/1980 | Fischer . | |
| 4,231,575 | | 11/1980 | Kutt . | |
| 4,238,262 | | 12/1980 | Fishel . | |
| 4,249,731 | | 2/1981 | Amster . | |
| 4,273,331 | | 6/1981 | Fisher . | |
| 4,274,634 | | 6/1981 | Berluti . | |
| 4,279,418 | * | 7/1981 | Lacoste | 473/541 |
| 4,318,545 | * | 3/1982 | Husted | 473/543 |
| 4,339,130 | | 7/1982 | Husted . | |
| 4,377,288 | | 3/1983 | Sulprizio . | |
| 4,391,391 | | 7/1983 | Robaldo . | |
| 4,458,898 | | 7/1984 | Boden . | |
| 4,462,591 | | 7/1984 | Kenworthy . | |
| 4,488,722 | | 12/1984 | Harz . | |
| 4,593,905 | | 6/1986 | Abel . | |
| 4,597,576 | | 7/1986 | Haythornthwaite . | |
| 4,685,676 | | 8/1987 | Boden . | |
| 4,741,531 | | 5/1988 | Szedressy . | |
| 4,949,968 | | 8/1990 | Korte-Jungermann . | |
| 5,131,653 | | 7/1992 | Yu . | |
| 5,141,227 | | 8/1992 | Flamm . | |
| 5,141,228 | | 8/1992 | Soong . | |
| 5,143,669 | * | 9/1992 | Mott | 473/541 X |
| 5,150,896 | | 9/1992 | Holmes . | |
| 5,158,285 | | 10/1992 | Flamm . | |
| 5,303,918 | | 4/1994 | Liu . | |
| 5,346,211 | * | 9/1994 | Ou et al. | 473/540 |
| 5,346,212 | | 9/1994 | Kuebler . | |
| 5,470,066 | | 11/1995 | Soong . | |
| 5,536,005 | | 7/1996 | Koff . | |
| 5,570,883 | | 11/1996 | Csabai . | |
| 5,759,122 | * | 6/1998 | Yu | 473/543 |

FOREIGN PATENT DOCUMENTS

| | | | | |
|---|---|---|---|---|
| 2510386 | * | 9/1975 | (DE) | 473/FOR 179 |
| 2719752 | * | 11/1978 | (DE) | 473/FOR 178 |
| 2587902 | * | 4/1987 | (FR) | 473/FOR 178 |

* cited by examiner

*Primary Examiner*—Raleigh W. Chiu

(57) ABSTRACT

A string network for sports rackets comprises joined rectilinear string segments forming a single monolithic volume with regular openings. String networks with openings of quadrilateral, hexagonal and triangular form are shown. Being bonded and secured to each other, and having a streamlined cross-sectional area, the string segments do not move with respect to each other and stay oriented so as to minimize wind resistance during the swinging motion of the sports racket before and after ball contact. The string network is materially separated from the frame of the racquet, and means for securing the network to the frame using conventional stringing machinery are presented.

15 Claims, 13 Drawing Sheets

Fig. 4a
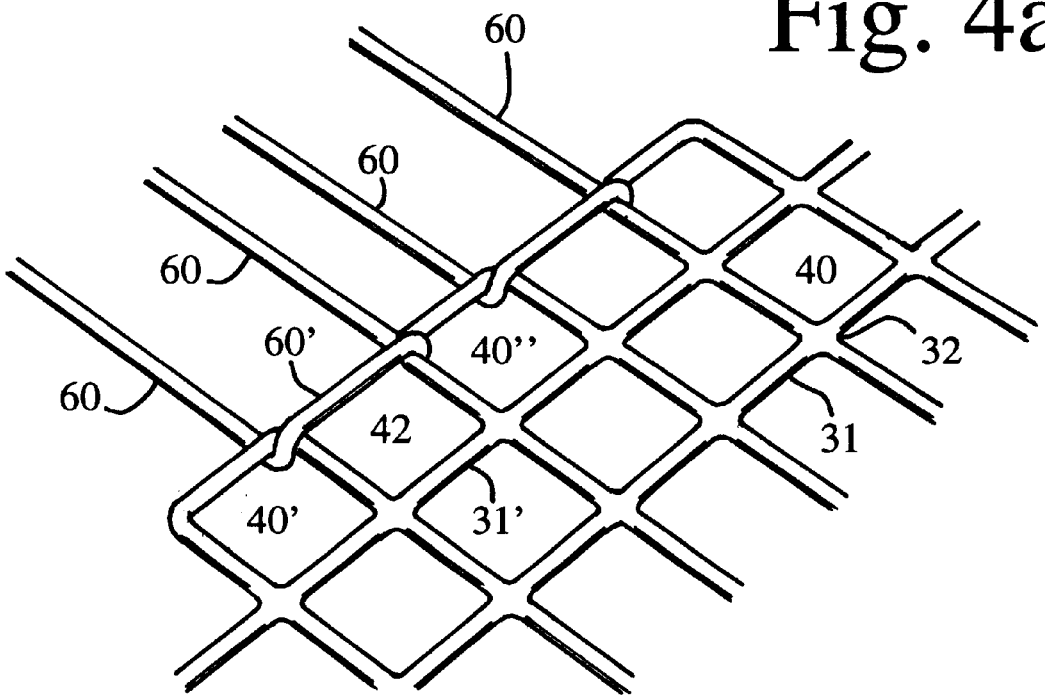
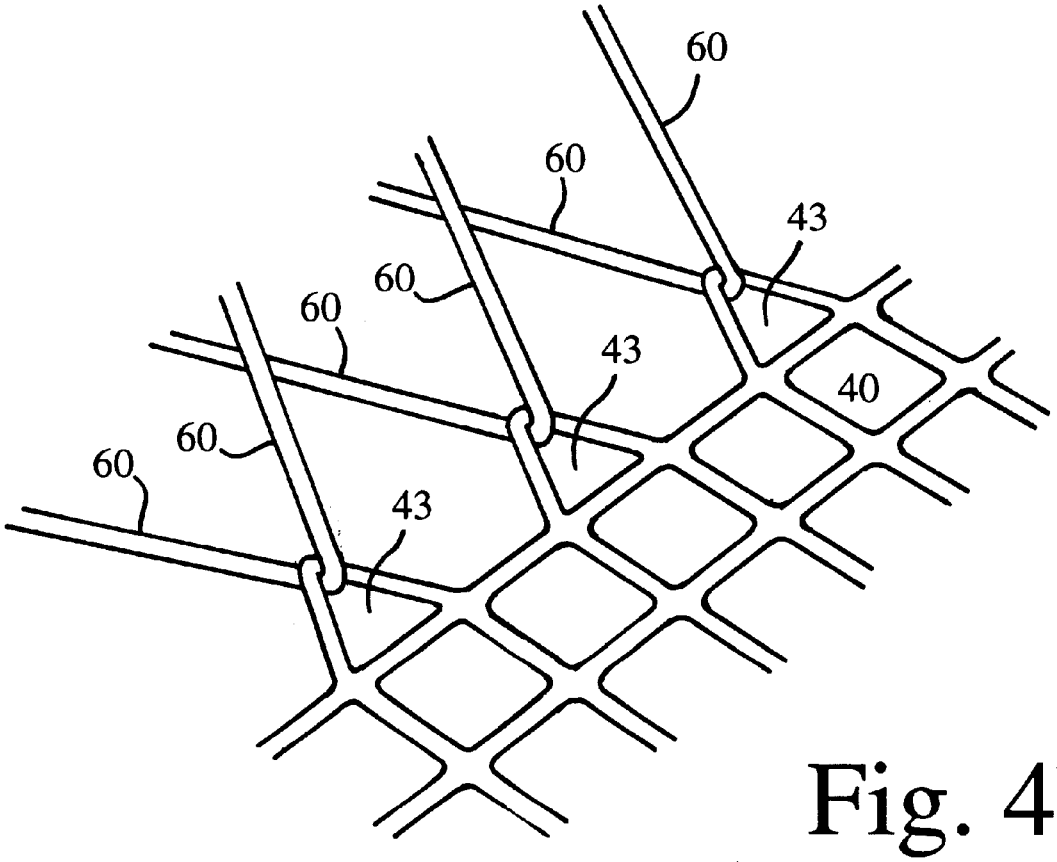
Fig. 4b

/ 13

MONOLITHIC STRING NETWORK FOR SPORT RACKETS

BACKGROUND OF THE INVENTION

1. Field of the Invention

This invention relates to a stringing for a sports racket such as, but not limited to, a tennis racket or a racket-ball racket.

2. Background Information

Conventional sports rackets are strung with strings passed above and below each other to produce a woven string network. Since the strings are not bonded at their crossover points, the pattern of the string network may deform when the ball is struck by a racket with an upwards or downwards component of motion, such as that used by players wishing to place spin on the ball. The movement of the strings relative to one another produces wear through attrition and leads to premature string failure.

Conventional sports rackets are strung with strings with circular cross-sectional area. These strings are essentially long cylinders, and cylinders are aerodynamically categorized as bluff bodies. Hence, during the swinging motion of the racket, the air flowing through the string network produces large wakes behind each string, leading to significant aerodynamic drag that must be overcomed by additional work by the player.

Much of the prior art relating to the reduction or elimination of abrasion due to string motion introduces structural changes to the conventional string surface that maintain or increase the level of aerodynamic drag. For example, U.S. Pat. No. 4,249,731 (Amster) teaches grid members slidable on strings during the stringing process, the grid members bonded together to form a unitary grid. The grid members add thickness to the strings and increase substantially the drag. Furthermore, the tight fit that is necessary between the grid members and the strings to avoid rattling and energy losses during ball contact renders the stringing process difficult and impractical. U.S. Pat. No. 5,303,918 (Liu) teaches a string network wherein relative string motion is impaired by impregnating the ball-striking surface in an elastic covering after the ball-striking surface is formed by attaching the strings to the frame, essentially replacing the slidable grid members of U.S. Pat. No. 4,249,731 with an in situ casted material. The elastic covering more than doubles the effective thickness the strings, leading to a large and detrimental increases in aerodynamic drag. Furthermore, since racket stringing and re-stringing is commonly done at sports shops, this approach necessitates special molds, procedures and material know-how not available at sports shops.

Much of the prior art relating to string geometry introduces string crosssections having higher drag than a conventional string with circular cross-section and equal area. For example, U.S. Pat. No. 4,377,288 (Sulprizio), U.S. Pat. No. 4,597,576 (Haythornthwaite), and U.S. Pat. No. 4,462,591 (Kenworthy) present strings with noncircular cross-sections. In all three cases the strings are not streamlined since the strings, after mounting on the sports racket, have a higher drag than strings with circular cross section and equal cross-sectional area when the racket is swung in the usual manner.

U.S. Pat. No. 3,934,876 (Haddad) and U.S. Pat. No. 5,150,896 (Holmes) teach a racket with a ball-striking surface that is materially inseparable from the frame, and whose elements obtain the necessary rigidity through large cross-sectional area rather than through tension. As such, it is not possible for the racket user to tailor those playing properties of the racket normally selected through string tension, nor is it possible for the user to purchase a racket frame and a ball-striking surface independently from one another or replace the ball-striking surface in the event of damage.

OBJECTS AND ADVANTAGES

Accordingly, several objects and advantages of my invention are:

a) A string network comprising strings with lower aerodynamic drag than strings with circular cross-section and equal cross-sectional area.

b) A string network with impaired motion of strings relative to one another, leading to reduced wear between strings.

c) A string network that is independently manufactured, and, optionally, independently distributed, from the racket frame.

d) A string network mountable on the racket frame using the conventional stringing machines found in sports shops, and using stringing procedures essentially equal to, or similar to, those currently in use at sports shops.

SUMMARY OF THE INVENTION

The preferred embodiment of the present invention has a new stringing design wherein rectilinear string segments join with one another to form a string network of monolithic volume having an essentially regular pattern of holes. The string network is attached to the racket frame under a user-selected amount of tension using the conventional stringing machines found in sports shops, and using stringing procedures essentially equal to, or similar to, those currently in use at sports shops. The network can be detached from the frame for replacement or re-tensioning at any time during the life of the racket.

To construct the monolithic string network, each extremity of each string segment is united with the extremity of at least one other string segment to form a junction capable of withstanding tension and twisting moments along the axis of the string segments. This property allows the string segments to maintain their orientation relative to one another at all times of play, except possibly during the relatively short duration of impact with the ball. Consequently, the string segments can be given a streamlined cross-section and can be correctly oriented relative to the frame of the racket to yield lower drag than conventional circular strings of equal cross-sectional area when the string network is moved in a direction essentially normal to the plane of the string network, as when the racket is swung by the player to hit a ball.

For rackets having conventional holes on the frame for receiving strings, a string section is woven under tension between the string network and the frame to attach the string network to the racket. For rackets having fasteners for fixing individual strings to the frame, the string network is attached directly to the frame.

DESCRIPTION OF THE FIGURES

FIG. 4*a* is an enlarged perspective view of a representative portion of the perimeter of the string network of FIG. 1;

FIG. 4*b* is an enlarged perspective view of a representative portion of the perimeter of another embodiment of the string network, wherein the coupling means for receiving the string means for attaching the network to the frame is characterized by triangular openings;

NOMENCLATURE

Within the specification and the claims, the following words carry the meaning assigned below:

rectilinear string segment: An essentially straight portion of string with length smaller than the radius of the sports ball used in conjunction with the sports racket, whereby the rectilinear string segment has two extremities.

string network: An essentially planar structure created from a plurality of rectilinear string segments by uniting each extremity of each rectilinear string segment with the extremity of at least one other string segment, the string segments being so arranged as to define a regular pattern of openings; the union between linear string segments comprising a complete fusion of at least the outer material of each segment so as to form a resilient junction with a materially continuous surface, thereby making the string network a monolithic structure.

streamlined cross-section: a cross-section having the property that the body occupying the region defined by a virtual extrusion of the cross-section to a given length L exhibits lower aerodynamic drag than the drag of a cylinder of length L having equal cross-sectional area, when the body is properly oriented in the air stream.

peripheral string segment: A string segment located on, and defining part of, the periphery of the string network.

peripheral openings: Openings defined by string segments, with two or more of the string segments being peripheral string segments.

string section: A portion of string having one end materially united with the string network, and the other end in contact with the frame of the sports racket.

In the specification and in the claims, is taken as self-evident that a string network necessarily possesses a periphery, and, thus, peripheral string segments, since the string network is flat and of finite dimensions.

DESCRIPTION OF THE PREFERRED EMBODIMENTS

The drawings represent only the preferred form of the invention and are only to be considered as examples.

Figure 1:
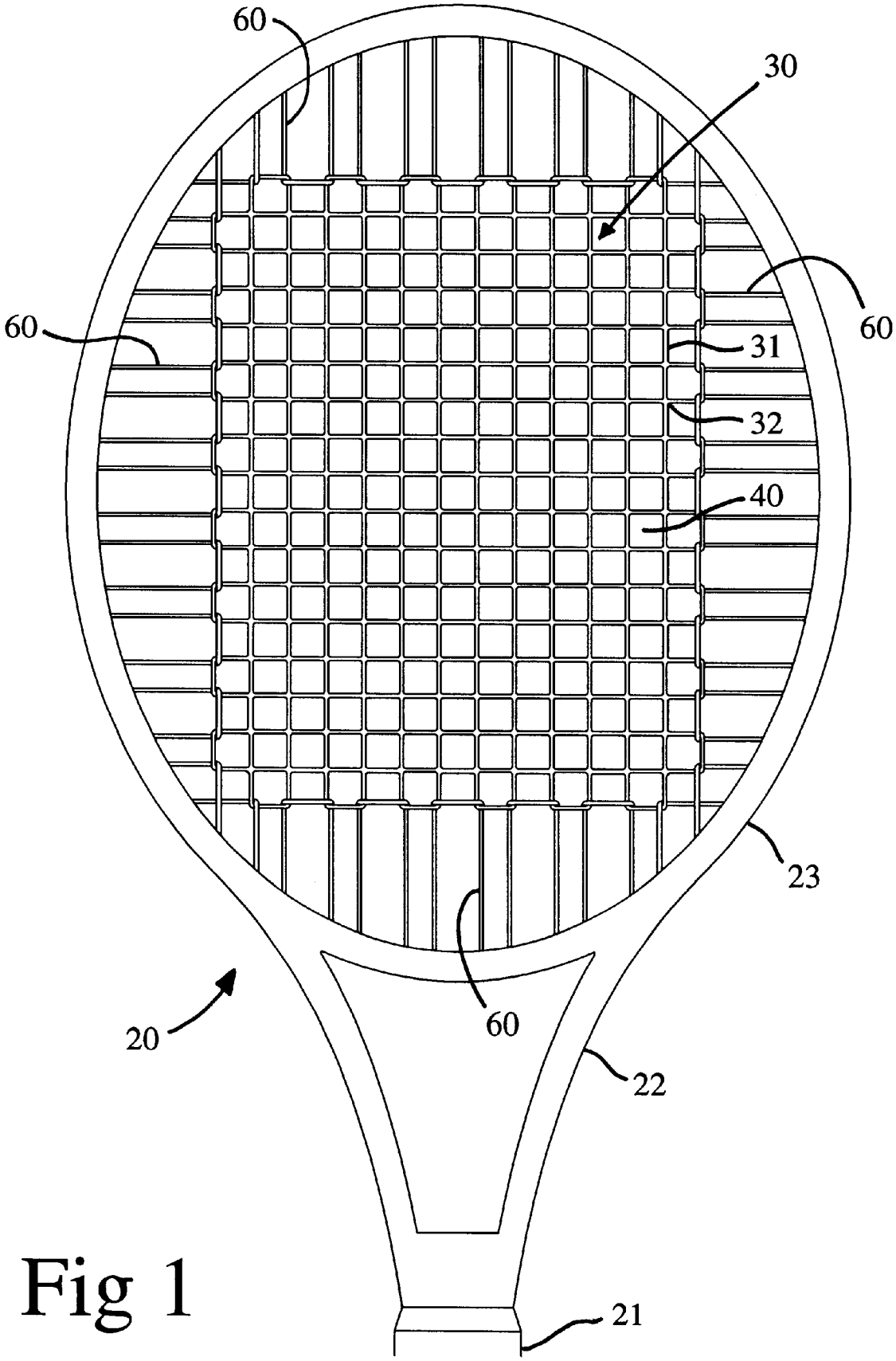
FIG. 1 is a frontal view of the sports racket with the preferred embodiment of the string network.

FIG. 1 shows the preferred embodiment of the sport racket of this invention. The sport racket has a frame 20 having a handle 21, only partially shown, a throat portion 22 and a head portion 23. The head portion contains conventional holes for receiving strings, the holes extending through the thickness of the frame. The head portion defines a central opening wherein a ball-striking surface is located. The ball-striking surface comprises a string network 30 and a string means for securing the string network to the frame. In this embodiment, the string means is a first string 60 woven between the frame and the string network. The string network 30 comprises rectilinear string segments 31 lying on an essentially flat plane. The extremities of the rectilinear string segments unite at junctions 32. The ensemble of rectilinear string segments define a regular pattern of quadrilateral openings 40. Only a selected few of the string segments, junctions, and openings are labeled in FIG. 1 in order not to unduly complicate the drawing.

Figure 2:
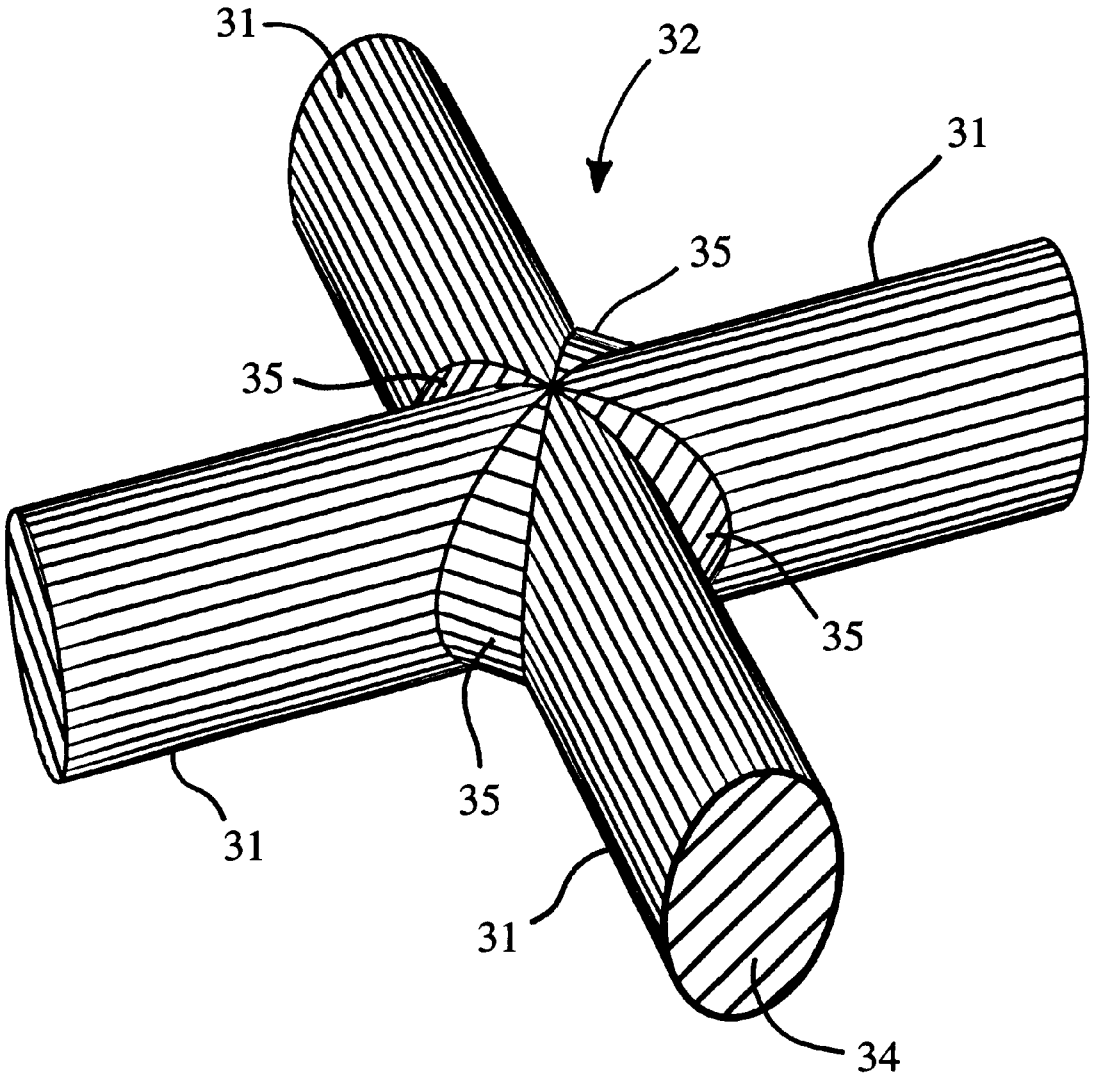
FIG. 2 is an enlarged view of a representative four-way joint between string segments within the string network of FIG. 1.

A close-up image of one representative junction from the string network is shown at 32 in FIG. 2. The union between the four rectilinear string segments 31 occurs as a complete fusion of at least the outer material of each string segment so as to create the resilient junction 32 capable of withstanding tension and twisting moments along the axis of the four string segments, thereby maintaining the string segments in their relative orientation before and after impact with the sports ball. Accordingly, the string segments can be endowed with a streamlined cross-section, such as the elliptical cross-section 34, oriented for minimum drag when the string network moves perpendicular to its plane. The fusion of string segment material at the junctions forms a materially continuous surface that defines a monolithic volume occupied by the ensemble of string segments. The junction is given filets 35 for additional strength.

Referring back to FIG. 1, the first string 60 attaches to the frame in the conventional fashion wherein the first string 60 coming from the string network is threaded through a first hole in the frame, around a portion of the perimeter of the frame and through a second hole to return to the string network and repeat the process.

The string network contains a coupling means for receiving the string means for securing the string network to the frame. The coupling means has the dual purpose of providing the structure necessary for connecting the string means to the string network, and transmitting the tension in the string means essentially equally through the string segments of the network.

Figure 3:
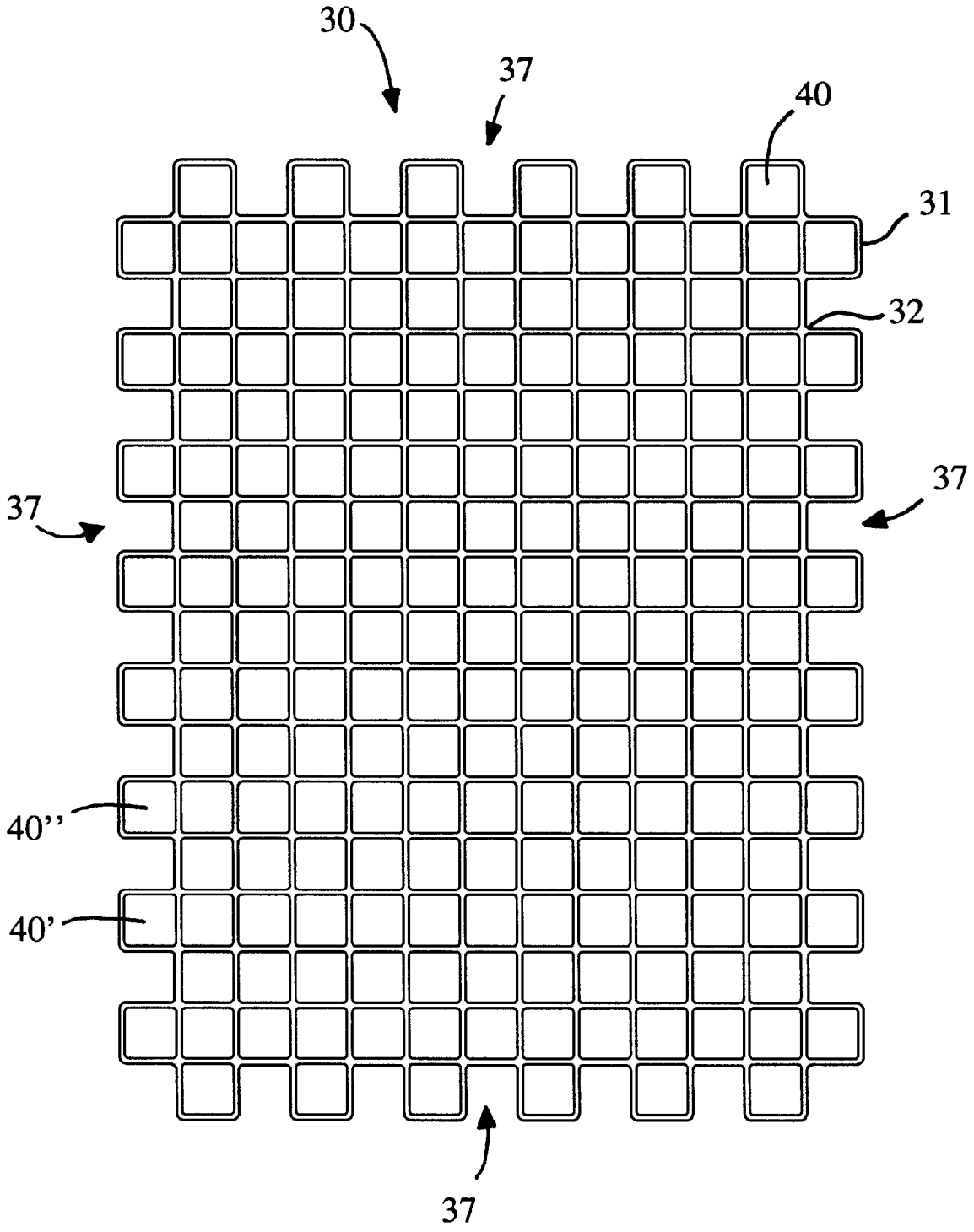
FIG. 3 is a frontal view of the isolated string network of the preferred embodiment.

FIG. 3 shows the string network of the preferred embodiment in isolation. The coupling means takes the form of a serrated perimeter 37 along the string network. This coupling means can be most easily understood by conceptually taking an imaginary string network with a perimeter of essentially quadrilateral form and removing every other string segment along the straight portion of the perimeter of the string network, and removing both string segments defining each corner of the imaginary string network. The peripheral openings, such as those shown at 40' and 40", then provide the structure for connecting the string means to the network. In more concise wording, the coupling means for said embodiment manifests itself as a serrated perimeter 37 wherein any two consecutive string segments along the perimeter junction at essentially 90 degree angles.

FIG. 4*a* shows a detail of the string network during the application of the string means for securing the network to the frame. The first string 60 is woven between the frame and the string network. During the weaving process, the first string 60 is passed though a first peripheral opening 40', then pushed parallel to the peripheral string segment 31', through a second peripheral opening 40", and back to the frame. Consequently, a portion of the first string, shown at 60', structurally replaces the missing string segment between peripheral openings 40' and 40", thereby distributing essentially equal tension amongst each string segment in the network when the first string 60 is placed under tension.

In another embodiment of the invention, the coupling means for receiving the string means for securing the network to the frame comprises peripheral string segments forming triangular openings 43 along the perimeter of the string network, as shown in FIG. 4*b*. The resulting string network can be visualized by taking the string network of the preferred embodiment shown in FIG. 3, and changing the peripheral string segments so that each peripheral quadrilateral opening is changed into a triangular opening.

Figure 5:
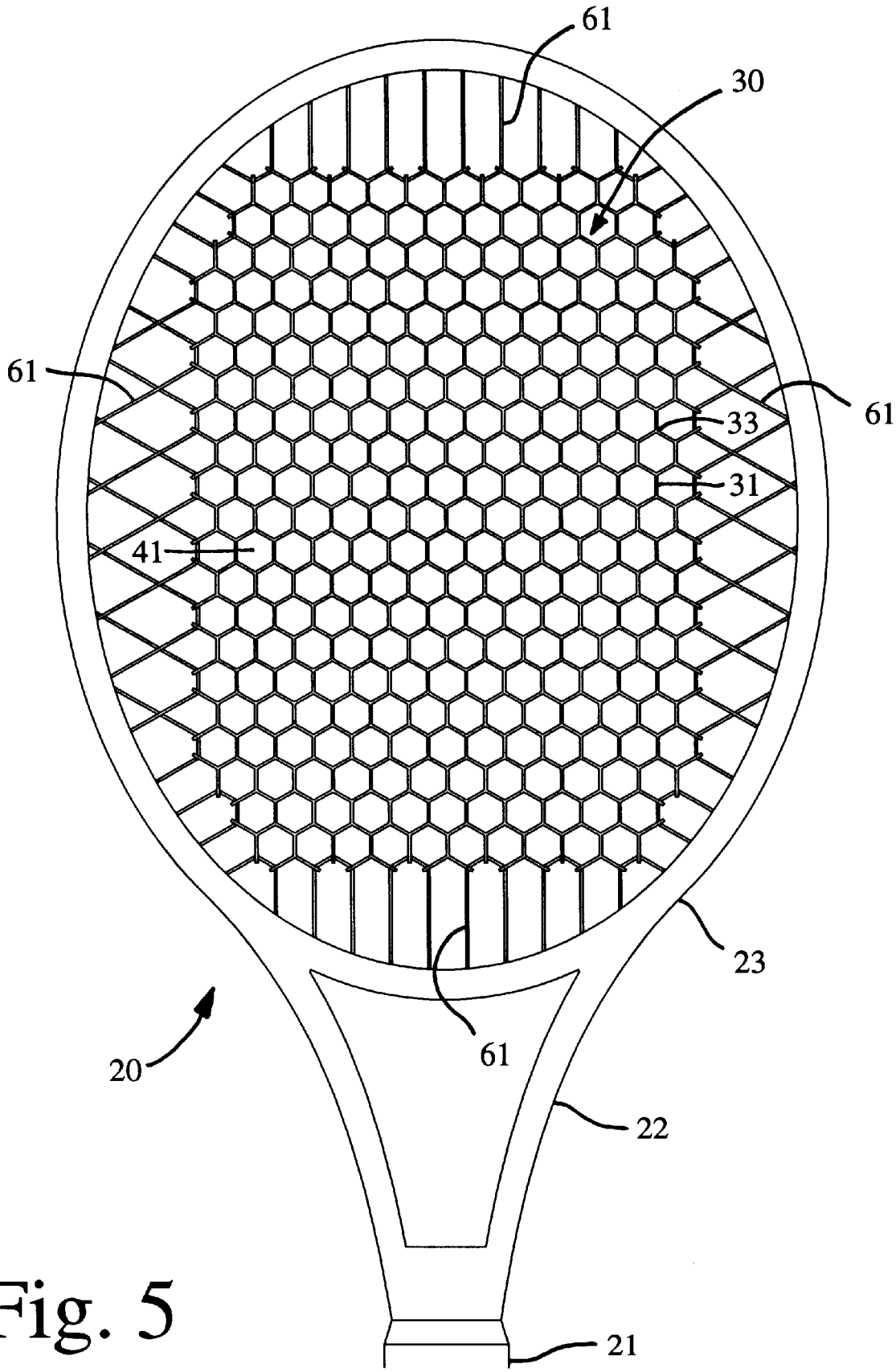
FIG. 5 is a frontal view of the sports racket with another embodiment of the string network.

FIG. 5 shows another embodiment of the sport racket of this invention wherein the string network is characterized by a regular pattern of hexagonal openings 41. The rectilinear string segments 31 unite at junctions 33. Only a selected few of the string segments, junctions, and openings are labeled in FIG. 5 in order not to unduly complicate the drawing. In this embodiment, the string means is a second string 61 woven between the frame and the string network.

Figure 6:
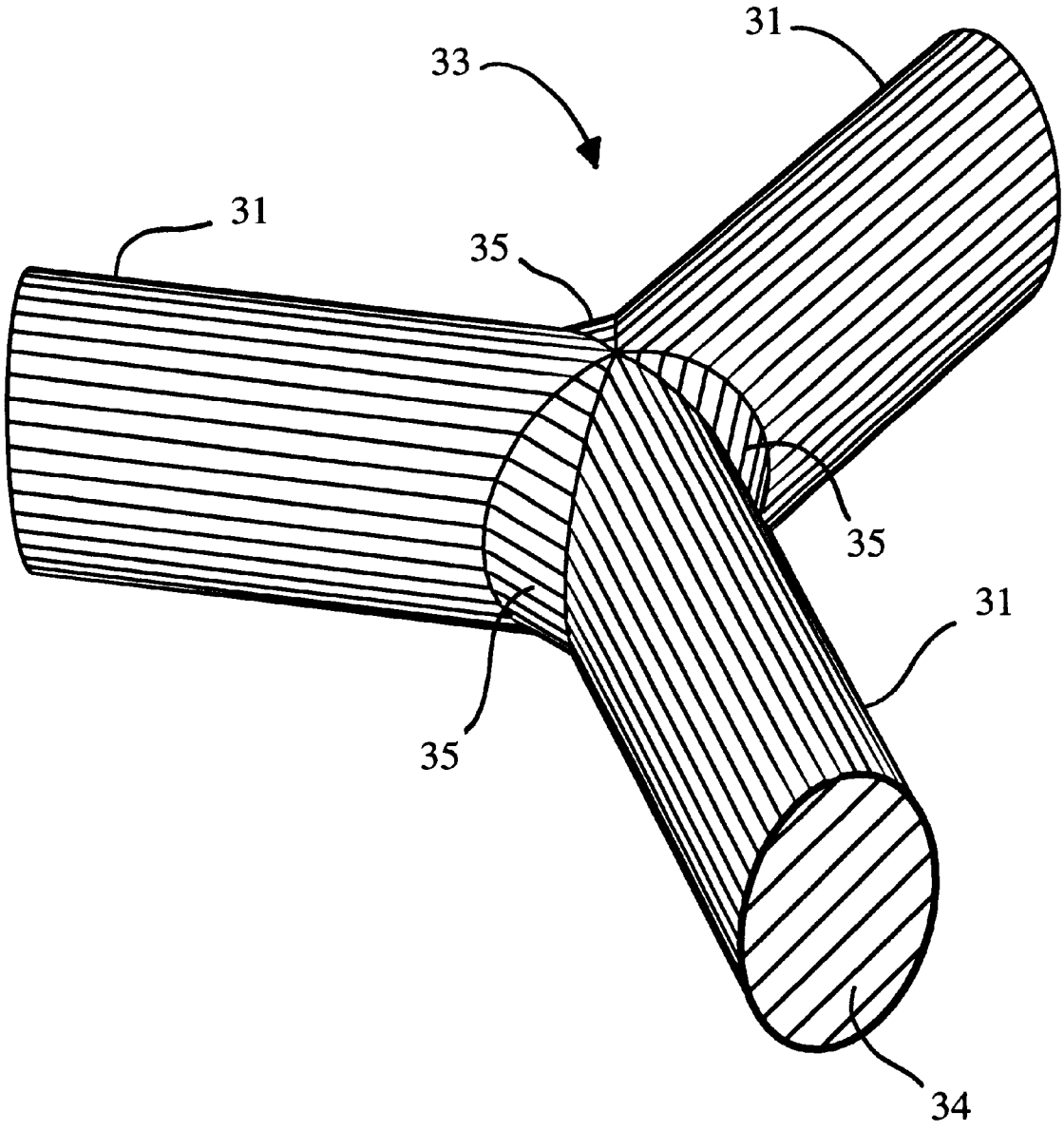
FIG. 6 is an enlarged view of a representative three-way joint between string segments within the string network of FIG. 5.
Figure 7:
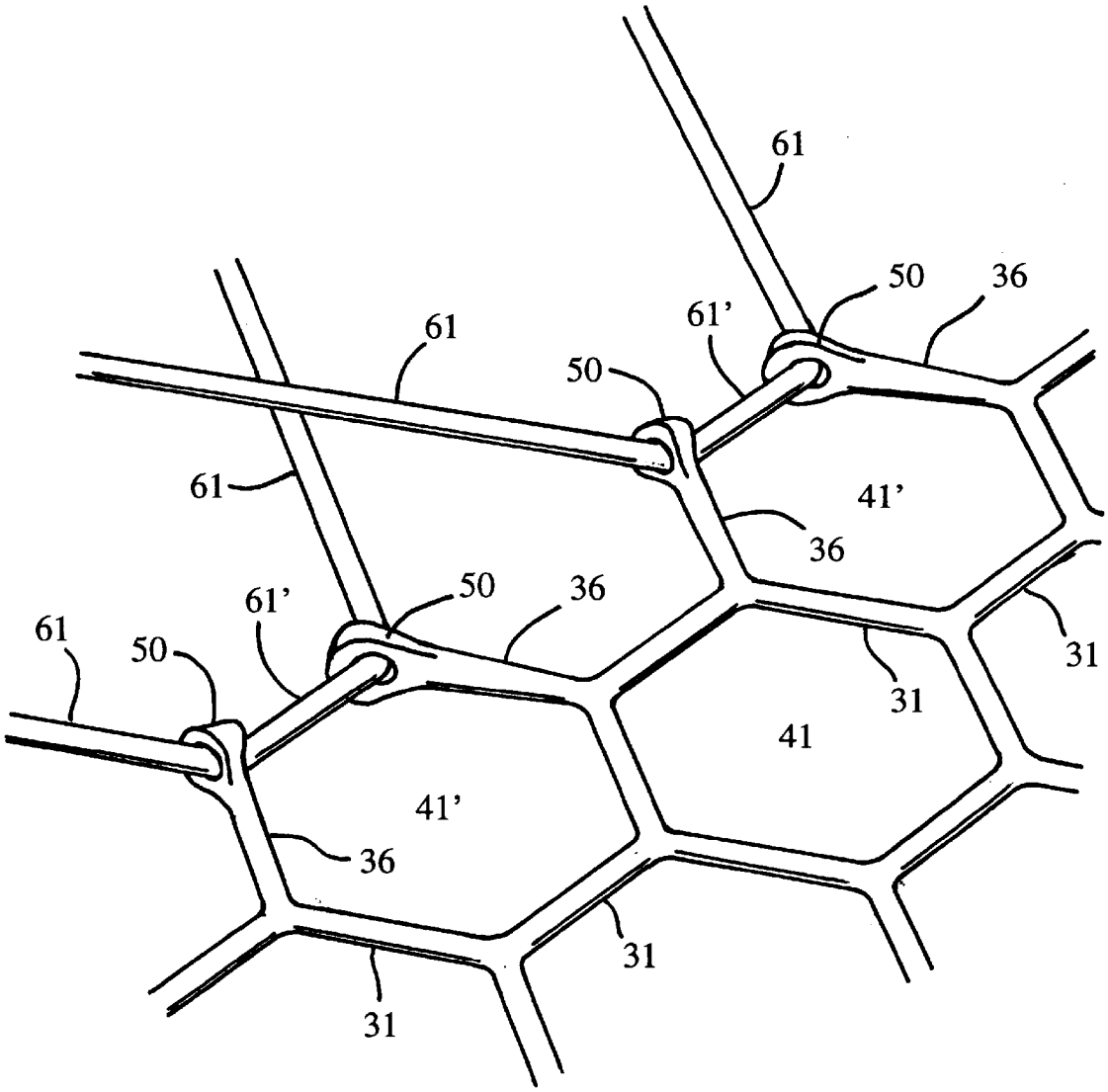
FIG. 7 is an enlarged perspective view of a representative portion of the perimeter of the string network of FIG. 5.

A detail view of one junction is shown at 33 in FIG. 6. The function of the filets 35 and of the streamline cross-section, here shown a an elliptical cross-section 34, is as described above for the four-way junction. The coupling means takes the form of peripheral string segments 36 attached to the network at one extremity and comprising an end-loop 50 at the unattached free extremity. The end-loop receives the string means for securing the string network to the frame, as shown in FIG. 7. When the second string 61 is weaved through the end-loops 50, the portion 61' of the second string 61 between two nearest consecutive end-loops 50 together with the peripheral string segments 36, and the remainder of the string network, define an opening of hexagonal form 41'. The second string 61 is lead to and way from the string network along directions parallel to the peripheral string segments 36, whereby placing the second string 61 under tension causes all string segments to experience the same tension.

Figure 8:
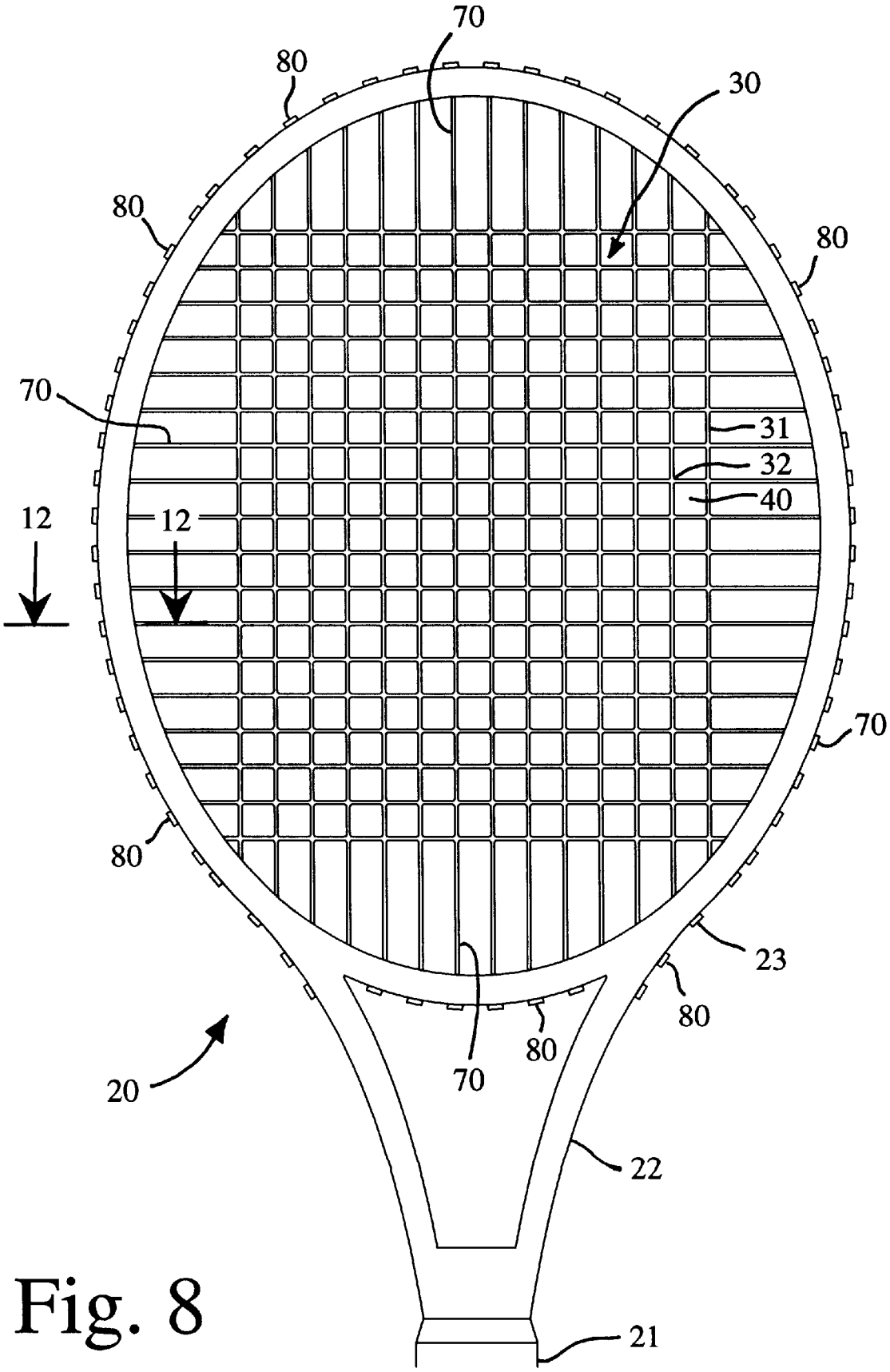
FIG. 8 is a frontal view of the sports racket with another embodiment of the string network.

FIG. 8 shows another embodiment of the sport racket of this invention wherein the string network having a regular pattern of quadrilateral openings 40 is adopted for mounting to a racket frame endowed with a plurality of fasteners 80. Only a selected few of the fasteners, string segments, junctions, and quadrilateral openings are labeled in FIG. 8 in order not to unduly complicate the drawing.

Each fastener firmly fixes one individual string to the frame. A string section 70 is bonded at each junction along the periphery of the string network, one string section 70 per junction, and extends to and engages with one of said fasteners, thereby fixing the string network to the frame.

Figure 9:
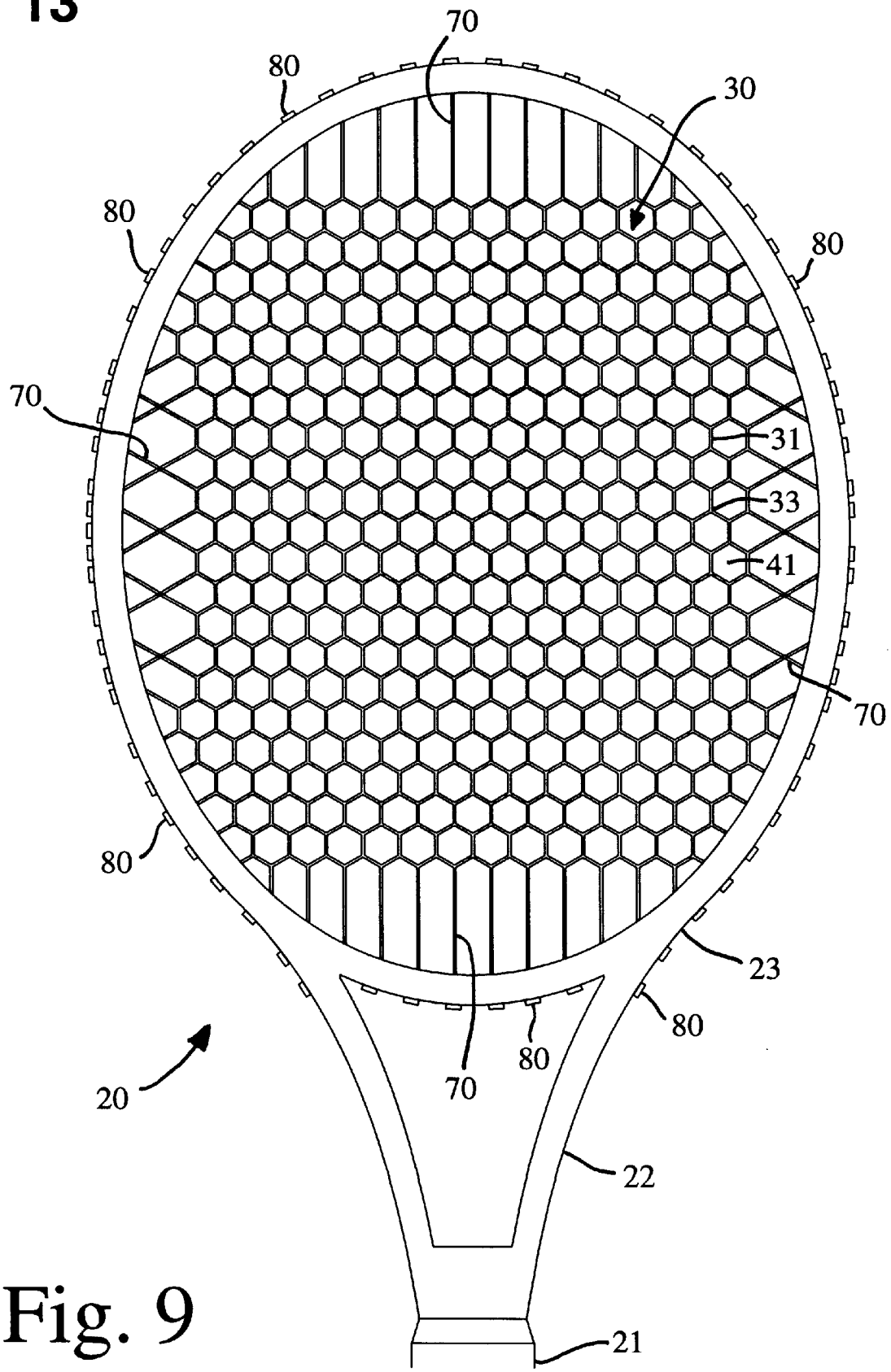
FIG. 9 is a frontal view of the sports racket with another embodiment of the present invention.

FIG. 9 shows another embodiment of the sport racket of this invention wherein the string network having a regular pattern of hexagonal openings 41 is adopted for mounting to a racket frame endowed with a plurality of fasteners 80. The string sections 70 connecting the string network to the fasteners leave the string network in a predetermined direction so that, at the location of union between peripheral string segments and each string section 70, the angles between peripheral string segments and string sections are essentially 120 degrees.

Figure 10:
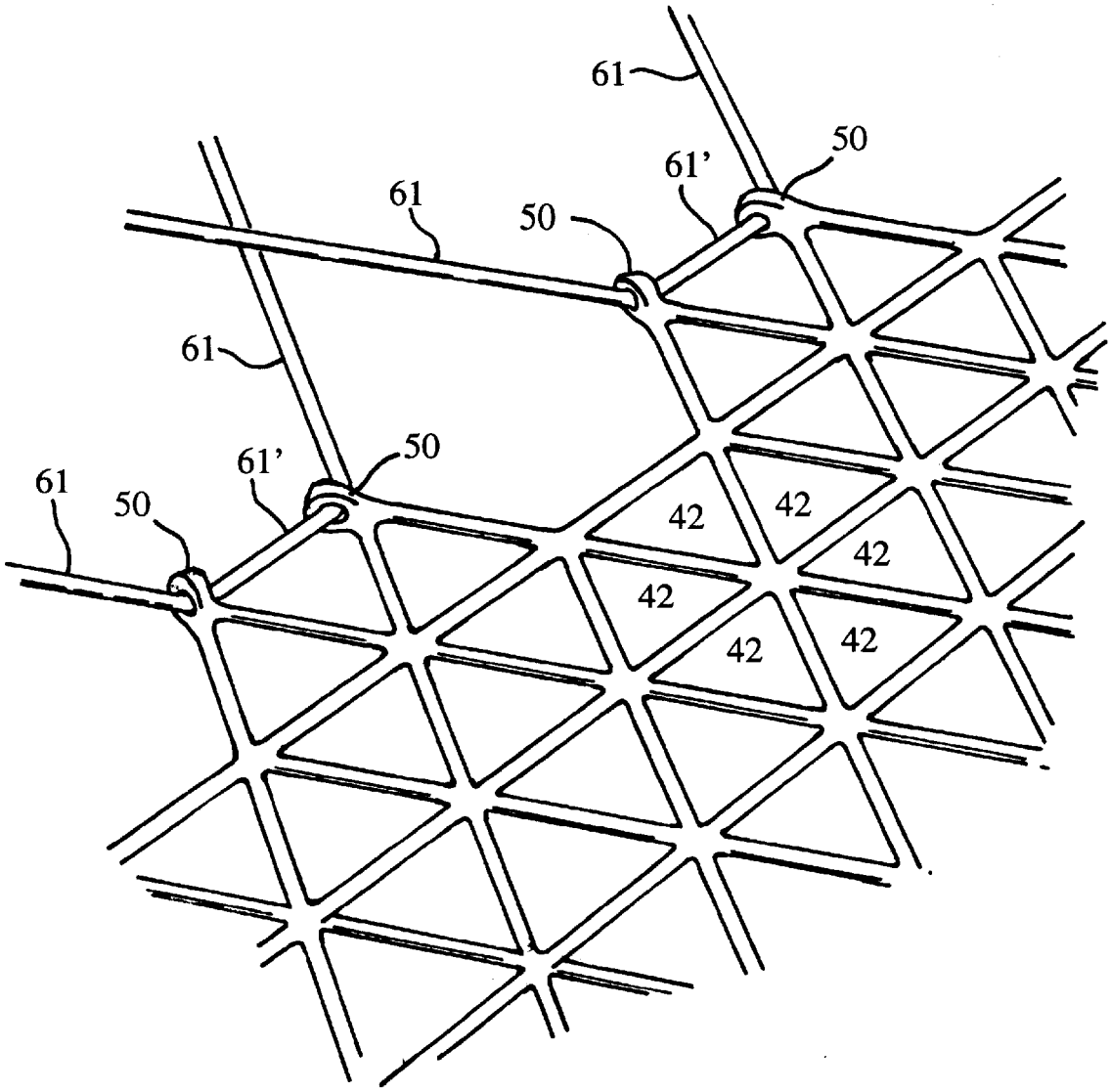
FIG. 10 is an enlarged perspective view of the string network in another embodiment of the present invention, and the string means for attachment to the frame.

FIG. 10 shows another embodiment of the sport racket of this invention wherein the string network has a regular pattern of triangular openings 42. By comparing FIG. 10 and FIG. 7 it can be seen that the string network with triangular openings is easily constructed by taking the string network with hexagonal openings 41 and adding string segments to divide each hexagon 41 into six triangles 42. Due to this straight-forward procedure, additional figures depicting the the string network with triangular openings are not shown in order not to unduly multiply the number of figures.

Figure 11:
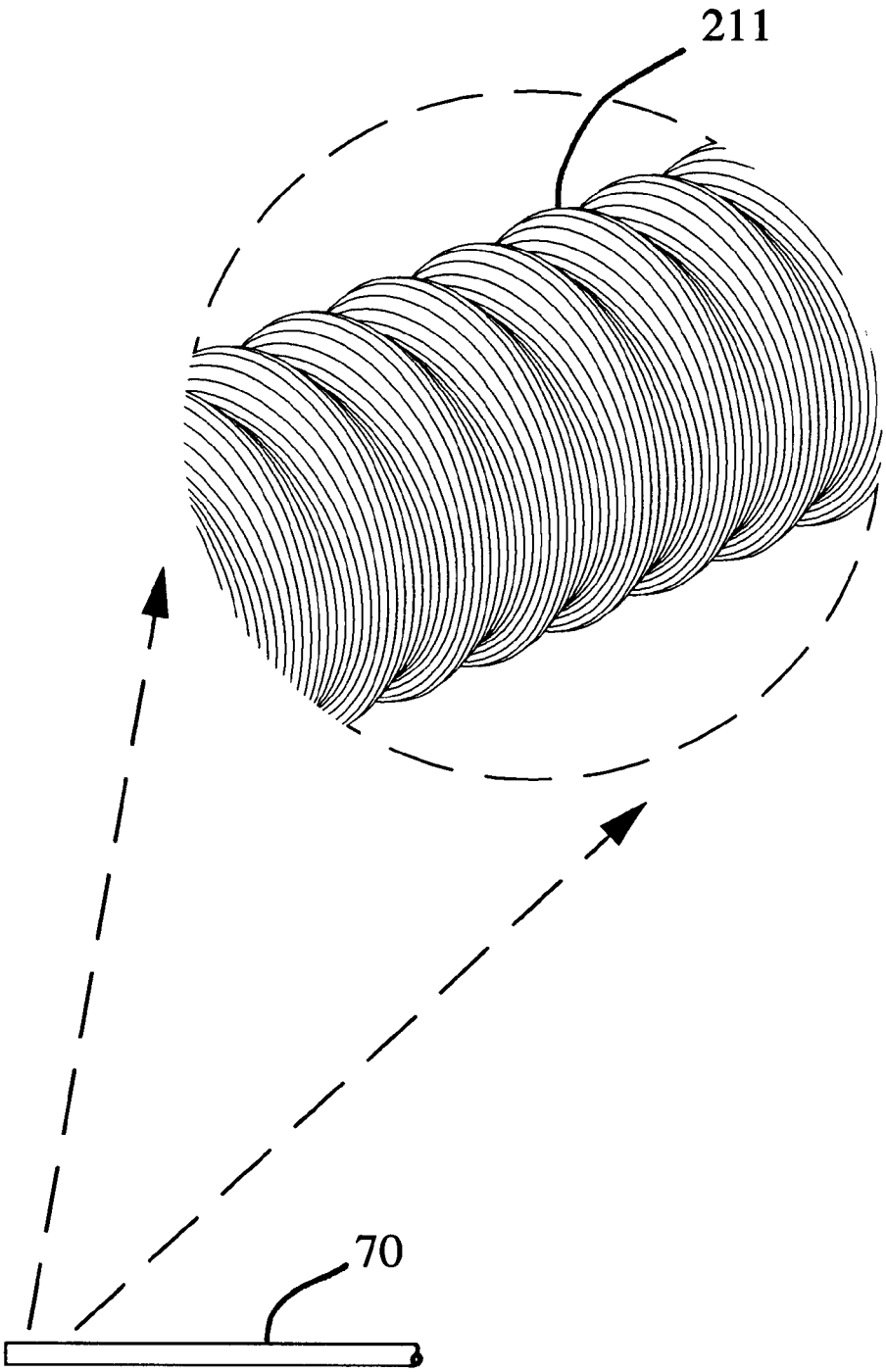
FIG. 11 is an enlarged perspective view of the end of the string section used for connecting the string network to the fasteners on the frame.

The portion of each string section 70 in contact with the fastener 80 contains string surface corrugations 211 oriented essentially perpendicular to the longitudinal axis of the string. An example of the string surface corrugations is shown in FIG. 11. The string surface corrugations improve the fixing ability of the string to the preferred fastener of this invention, described below.

THE STRING FASTENER

Figure 12:
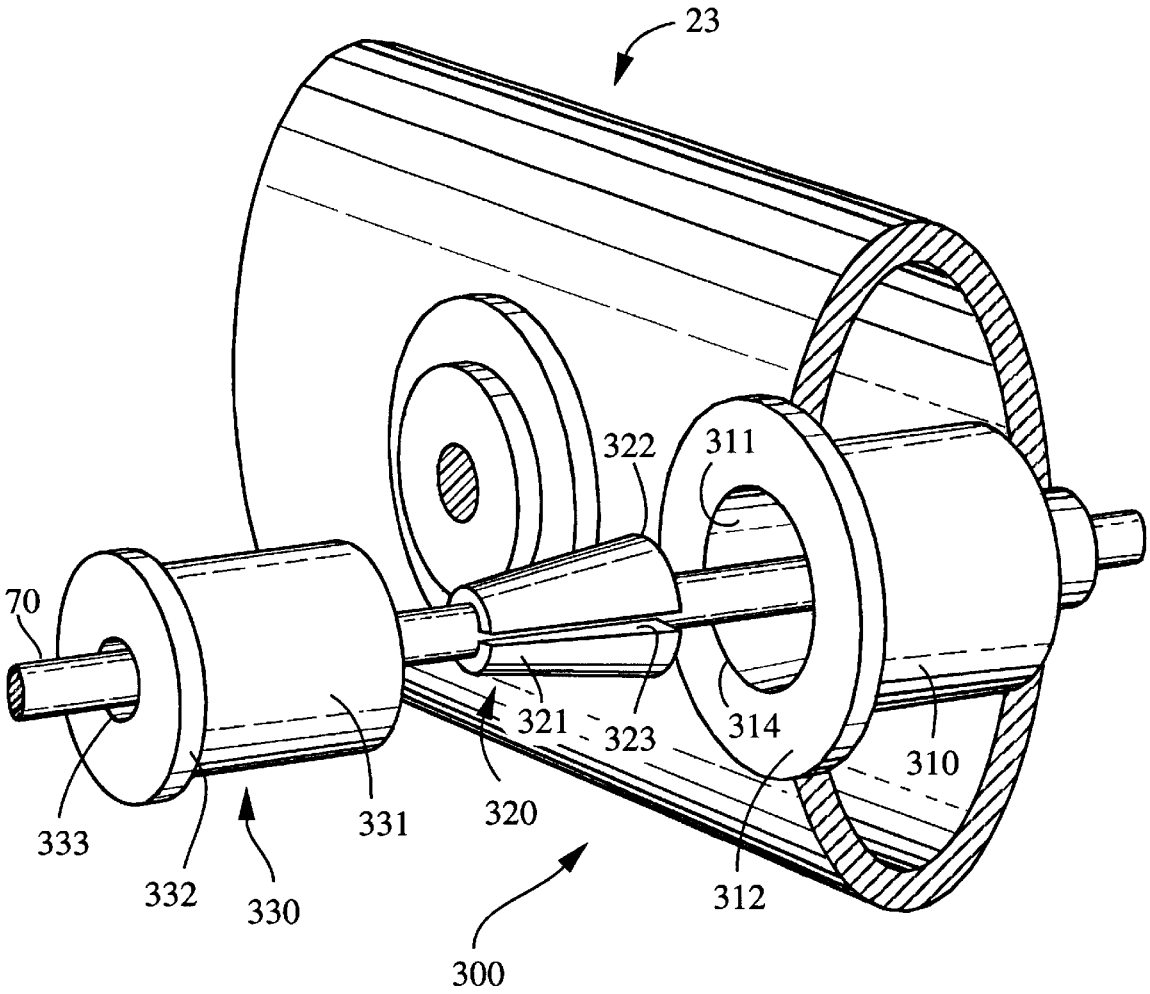
FIG. 12 is a cross-section of the frame taken along line 12—12 in FIG. 8, together with a perspective view of the components of the fastener.

The preferred embodiment of the fastener 80 is shown at 300 in FIG. 12. The fastener is used to firmly hold the free-end of an individual string segment 70 to the frame 23. The fastener comprises an enclosure body 310, a string clamping member 320 and a pressing means 330. These three parts are made from a resilient and light-weight material, such as plastic.

The string clamping member 320 has an wedge shaped outer surface 321, preferably of conical form, ending with an edge 322. The string clamping member has an inner passage-way to allow the passage of the individual string segment 70 through the string clamping member when there are no compressive forces acting on the wedge shaped outer surface 321. The inner passage-way contains transversal corrugations 325 (see FIG. 13*b*) to match the string surface corrugations 211 on the individual string segment. The string clamping member is made of a compliant material, such as nylon or similar polyamide, that allows the passage-way to radially contract when a compressive force is brought to bear on the wedge shaped outer surface. In the preferred embodiment, the radial contraction is aided by a cut 323 extending from the inner passage-way to the wedge shaped outer surface and running the entire length of the string clamping member.

The pressing means 330 has a cylindrical body 331, a small flange 332 connected to the cylindrical body, and a wedge shaped bore 335, preferably of conical form to match the preferably conical form of the wedge shaped outer surface 321 of the string clamping member 320. The wedge shaped bore extends the entire length of the cylindrical body and the small flange so as to create an opening 333, and, thus, a passage way for the individual string segment through the pressing means. The wedge shaped bore opens in the direction away from the small flange, and is sized to completely receive the string clamping member 320. Upon full insertion of the string clamping member 320 into the pressing means 330, the surface of the wedge shaped bore 335 pushes in a wedge fashion against the wedge shaped outer surface 321, thereby providing a compressive force to the wedge shaped outer surface and causing the inner passage-way of the string clamping member to radially contract. The pressing means furthermore comprises a locking means, preferentially in the form of an engaging lip 336 located at the larger opening of the wedge shaped bore for engagement with the edge 322 of the string clamping member, the locking means locking the string clamping member inside the wedge shaped bore when the string clamping member is fully inserted into the wedge shaped bore.

The enclosure body 310 extends through the frame and is fixedly attached to the frame. When the frame is hollow, the enclosure body has preferably an enclosure flange 312 to block the inward motion of the enclosure body into the frame, and, thus, help maintain the enclosure body fixedly attached to the frame.

Figure 13A:
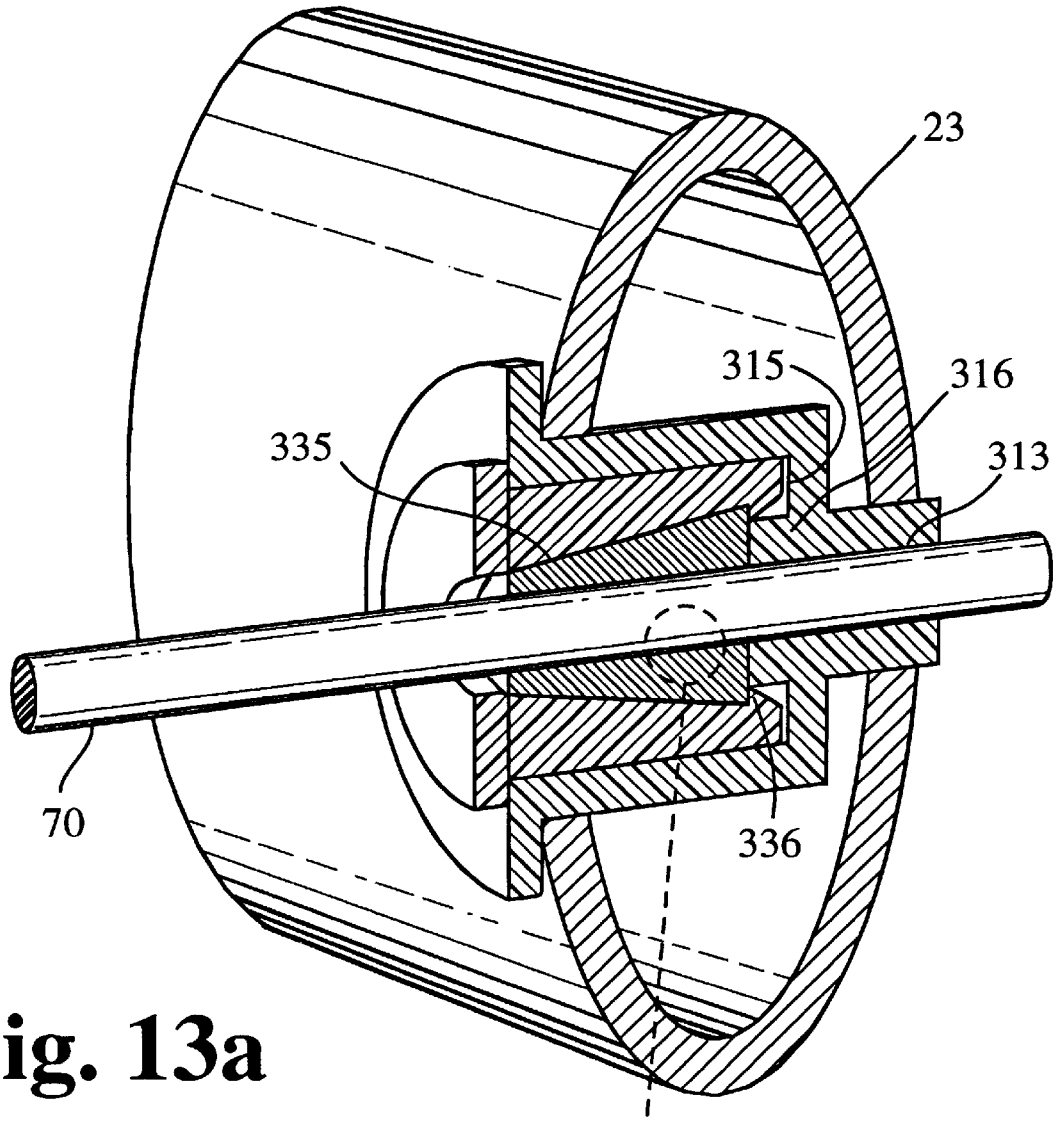
FIG. 13*a* is a cross-section taken along line 12—12 in FIG. 8, showing in perspective the components of the fastener in the locked position.
Figure 13B:
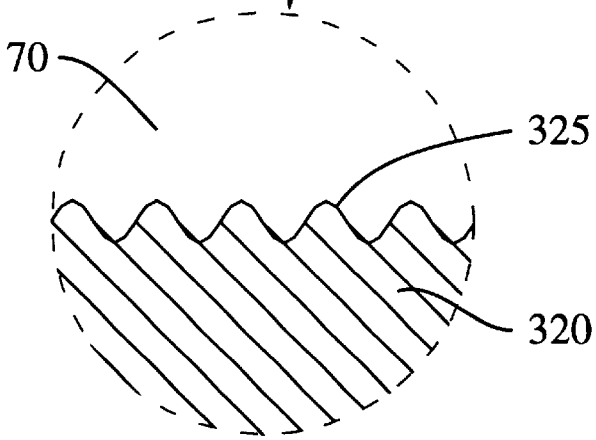
FIG. 13*b* is an enlarged cross-section of the string segment and string clamping member, showing a cross-section of the contact surface between these two elements.

The enclosure body 310 contains a second cavity 311 extending through the enclosure flange to produce a main opening 314, and extending partially into the enclosure body to produce a base surface 315 (see FIG. 13*a*). The base surface is connected to the inner head surface by a simple bore 313 to allow the passage of the individual string segment 70 through the enclosure body. Furthermore, the second cavity 311 is sized to receive through the main opening the cylindrical body 331 of the pressing means, but not the small flange 332 of the pressing means. The enclosure body in the preferred embodiment has a protrusion 316 at the base surface 315. The protrusion separates the string clamping member from the enclosure body to make the edge 322 reachable by the engaging lip 336.

To fasten the individual string segment to the frame, the individual string segment is threaded through the enclosure body 310 in the direction from inner head surface to outer head surface, and further threaded through the string clamping member in the direction of decreasing thickness of the wedge shaped outer surface, and through the pressing means in the direction of decreasing cross-sectional area of the wedge shaped bore. The individual string segment then proceeds to a conventional string tensioner to receive the desired tension. Once the desired tension is reached, the string clamping member is slid along the individual string segment into the enclosure body until coming to rest against the base surface of the enclosure body. Afterwards, the pressing means is inserted into the enclosure body and over the string clamping member, causing the wedge shaped bore to slide over the wedge shaped outer surface of the string clamping member and to cause a compressive force on the wedge shaped outer surface. Upon full insertion, the engaging lip 336 engages with the edge 322 to lock the pressing means and the string clamping member together. Since the protrusion prevents further motion of the string clamping member into the second cavity 311, the wedging action between the string clamping member and the pressing means causes the string clamping member to radially contract, whereby the surface of the passage-way in the string clamping member contracts and firmly presses against the individual string segment to fasten the individual string segment to the frame.

To remove the pressing means and the string clamping member form the enclosure body after the pressing means and the string clamping member are interlocked with each other, the individual string segment is cut. The ensemble of cut string segment, pressing means and clamping means is then discarded, leaving the fastener ready to receive a new string segment, a new pressing means and a new clamping member.

I claim:

1. A sport racket comprising:

a) a frame composed of a handle, a throat portion connected to the handle, and a head portion connected to the throat portion, the head portion enclosing a region to be occupied by strings, the head portion having a plurality of holes extending through the frame for receiving strings;

b) a string network materially separate from the frame, the string network composed of non-overlapping rectilinear string segments lying essentially on a single flat plane, at least one extremity of each string segment united with the extremity of at least one other string segment, each union between string segments forming a junction capable of withstanding tension and twisting moments along the axis of the string segments, the plurality of string segments and junctions producing a monolithic volume having an essentially regular pattern of openings, at least one rectilinear string segment having a streamlined cross-section when air flows in a direction essentially normal to the single flat plane, the perimeter of the string network having coupling means for receiving string means for securing the string network to the frame; and c) string means for securing the string network to the frame, the string means connecting to the coupling means and passing through said holes on said frame.

2. The sports racket of claim 1, wherein at least one opening is essentially of quadrilateral form.

3. The sports racket of claim 1, wherein at least one opening is essentially of hexagonal form.

4. The sports racket of claim 1, wherein at least one opening is essentially of triangular form.

5. A sport racket comprising:

a) a frame composed of a handle, a throat portion connected to the handle, and a head portion connected to the throat portion, the head portion enclosing a region to be occupied by strings, the head portion having a plurality of holes extending through the frame for receiving strings;

b) a string network materially separate from the frame, the string network composed of non-overlapping rectilinear string segments lying essentially on a single flat plane, at least one extremity of each string segment united with the extremity of at least one other string segment, each union between string segments forming a junction capable of withstanding tension and twisting moments along the axis of the string segments, the plurality of string segments and junctions producing a monolithic volume having an essentially regular pattern of openings, the perimeter of the string network having coupling means for receiving string means for securing the string network to the frame, the coupling means comprising peripheral string segments forming openings of form selected from the group consisting of quadrilateral and triangular forms; and c) string means for securing the string network to the frame, the string means connecting to the coupling means and passing through said holes on said frame.

6. The sports racket of claim 5 wherein at least one rectilinear string segment has a streamlined cross-section when air flows in a direction essentially normal to the single flat plane.

7. A sport racket comprising:

a) a frame composed of a handle, a throat portion connected to the handle, and a head portion connected to the throat portion, the head portion enclosing a region to be occupied by strings, the head portion having a plurality of holes extending through the frame for receiving strings;

b) a string network materially separate from the frame, the string network composed of non-overlapping rectilinear string segments lying essentially on a single flat plane, at least one extremity of each string segment united with the extremity of at least one other string segment, each union between string segments forming a junction capable of withstanding tension and twisting moments along the axis of the string segments, the plurality of string segments and junctions producing a monolithic volume having an essentially regular pattern of openings, the string network being entirely contained within said region to be occupied by strings, the perimeter of the string network having coupling means for receiving string means for securing the string network to the frame, at least one string segment along the perimeter of the string network being an unattached free extremity, the coupling means comprising an end-loop attached to said free extremity for receiving the string means for attaching the string network to the frame; and c) string means for securing the string network to the frame, the string means connecting to the coupling means and passing through said holes on said frame.

8. The sports racket of claim 7 wherein at least one rectilinear string segment has a streamlined cross-section when air flows in a direction essentially normal to the single flat plane.

9. The sports racket of claim 8 wherein the streamlined cross-section is of elliptical form.

10. A sport racket comprising:

a) a frame composed of a handle, a throat portion connected to the handle, a head portion connected to the throat portion and enclosing a region to be occupied by strings, the head portion having a plurality of fasteners for receiving and firmly attaching strings to the frame;

b) a string network materially separate from the frame, the string network having non-overlapping rectilinear string segments lying essentially on a single flat plane, each extremity of each string segment united with the extremity of at least one other string segment, each union between string segments forming a junction capable of withstanding tension and twisting moments along the axis of the string segments, the plurality of string segments and junctions producing a monolithic volume having an essentially regular pattern of openings; and, c) a string section bonded to the network and attached to the frame by one of said fasteners, said string section having surface undulations with ridges oriented essentially perpendicular to the axis of the string section, the surface of the one of said fastener in contact with the string having matching surface undulations, whereby the matching of string and fastener surface undulations hinders the slippage of the string section relative to the fastener.

11. The sports racket of claim 10 wherein at least one opening is essentially of quadrilateral form.

12. The sports racket of claim 10 wherein at least one opening is essentially of hexagonal form.

13. The sports racket of claim 10 wherein at least one opening is essentially of triangular form.

14. The sports racket of claim 10 wherein at least one rectilinear string segment has a streamlined cross-section when air flows in a direction essentially normal to the single flat plane.

15. The sports racket of claim 14 wherein the streamlined cross-section is of elliptical form.

* * * * *